US008434247B2

(12) United States Patent
Wurster

(10) Patent No.: US 8,434,247 B2
(45) **Date of Patent: *May 7, 2013**

(54) ELECTRIC MINING SHOVEL SADDLE BLOCK ASSEMBLY WITH ADJUSTABLE WEAR PLATES

(75) Inventor: Andrew M. Wurster, New Berlin, WI (US)

(73) Assignee: Harnischfeger Technologies, Inc., Wilmington, DE (US)

( * ) Notice: Subject to any disclaimer, the term of this patent is extended or adjusted under 35 U.S.C. 154(b) by 81 days.

This patent is subject to a terminal disclaimer.

(21) Appl. No.: 13/107,008

(22) Filed: May 13, 2011

(65) Prior Publication Data

US 2011/0214317 A1 Sep. 8, 2011

Related U.S. Application Data

(63) Continuation of application No. 11/853,784, filed on Sep. 11, 2007, now Pat. No. 7,950,171.

(51) Int. Cl.
*E02F 3/58* (2006.01)

(52) U.S. Cl.
USPC ..... 37/397; 37/399; 414/718; 414/728; 414/690

(58) Field of Classification Search ..... 414/718, 414/728, 690, 723, 724; 172/272, 273; 37/348, 37/397, 399, 400, 401, 396, 468
See application file for complete search history.

(56) References Cited

U.S. PATENT DOCUMENTS

| | | | |
|---|---|---|---|
| 2,211,194 | A | 8/1940 | Baker |
| 2,211,783 | A | 8/1940 | Knox |
| 3,045,844 | A | 7/1962 | Learmont et al. |
| 4,024,969 | A | 5/1977 | Hedeen |
| 4,339,225 | A | 7/1982 | Donnally et al. |
| 4,958,981 | A | 9/1990 | Uchihashi |
| 5,408,767 | A | 4/1995 | Hazama et al. |
| 5,469,647 | A | 11/1995 | Profio |
| 6,314,667 | B1 | 11/2001 | Rife et al. |
| 6,480,773 | B1 | 11/2002 | Hilgart |
| 6,533,053 | B2 | 3/2003 | Hayden |
| 6,764,270 | B1 | 7/2004 | Bernhardt et al. |

OTHER PUBLICATIONS

Examiners Report from the Canadian Intellectual Property Office for Application No. 2,639,469 dated Dec. 6, 2010 (3 pages).
Second Examiner's Report from the Canadian Intellectual Property Office for Application No. 2,639,469 dated Oct. 24, 2011 (3 pages).
Chilean Office Action from the Chile Intellectual Property Office for Application No. 2658-08 dated Aug. 9, 2008 (6 pages).
Office Action from Canadian Intellectual Property Office for Application No. 2,743,275 dated Dec. 7, 2012 (2 pages).

*Primary Examiner* — Stephen Vu
(74) *Attorney, Agent, or Firm* — Michael Best & Friedrich LLP

(57) ABSTRACT

A saddle block assembly including a main body having a shipper shaft opening through the main body bottom end, and an eccentric pin opening in the main body top end, an eccentric pin received in an eccentric pin opening in the top end of the main body, and a wear plate support. The wear plate support has a pin receiving opening, the eccentric pin being received in the pin receiving opening. Wear plates are mounted on the bottom end of the wear plate support and are adapted to bear against the top of a dipper handle.

23 Claims, 6 Drawing Sheets

ELECTRIC MINING SHOVEL SADDLE BLOCK ASSEMBLY WITH ADJUSTABLE WEAR PLATES

RELATED APPLICATION

The present application is a continuation of U.S. patent application Ser. No. 11/853,784, filed Sep. 11, 2007, which issued as U.S. Pat. No. 7,950,171 on May 31, 2011, the entire contents of which are hereby incorporated by reference.

SUMMARY

The present invention relates to power shovels and, more particularly, to power shovels having a dipper for excavating earthen material. More specifically, the present invention relates to saddle block assemblies that support the dipper handle or arm.

There are many known earth moving apparatuses or the like. Typical prior art earth moving equipment or excavators use a bucket or dipper assembly, on the end of a movable arm, to scoop earthen material from horizontal or vertical faces. The dipper is normally provided with sharp teeth to dig against the surface being worked. The dipper further includes a cavity for collecting the material so removed. Once the earthen material is received within the dipper, the arm is typically moved to another location for transfer of the material. The material is usually discharged into a dump truck, onto a conveyor, or merely onto another pile of material.

Large electric mining rope shovels utilize a digging attachment comprising a stationary boom and a combination handle and dipper structure that mounts on the boom and that actively crowds and hoists into a bank in order to fill the dipper. As shown in FIG. 2, the handle 26 comprises two legs 68 that pass on either side of the boom 22. The handle 26 has gear racking 62 attached to the bottom of each leg 68. A shipper shaft 66 having an axis 58 is also mounted horizontally through the boom 22. Two pinions 70 with splines 74 are attached to the shipper shaft 66. The gear racking 62 on the handle legs 68 engages the pinion gear splines 74. An electric motor and a transmission (not shown) rotate the shipper shaft and pinions, thus causing the handle and racking to crowd and retract from the boom. Two saddle block assemblies 78 are mounted on the shipper shaft 66 and are used to keep the handle 26 in the proper position while the shovel is operating.

During operation the handle sees forces in the vertical and horizontal directions. The vertical force is a result of the separating force between the gear racking on the handle and the crowd pinion, and from digging loads. The horizontal force is due to the machine swinging, digging loads, and from inertia. The purpose of the saddle block assemblies is to withstand these forces and keep the handle in position.

For best operation, there should be only a small gap in between the handle and the saddle block. This gap is ideally between 0.125 inches (0.3175 centimeters) and 0.25 inches (0.635 centimeters). If the gap increases beyond this amount, the system begins to experience a couple of problems. First the gaps between the components contribute to large shock loads as the parts move. Second, a large gap on top of the handle allows the handle racking and the crowd pinion to separate from each other. This greatly increases the load on the gear teeth leading to broken gear teeth, rough operation, and increased noise.

As the saddle block assembly provides support for the handle, the handle is frequently crowding or retracting in order to dig in the bank or to swing the shovel. The relative motion between the components causes wear on the surfaces of the saddle block that are in contact with the handle. The saddle block assemblies are large structures; therefore it is not conducive to replace the entire saddle block assembly because it has wear on a couple of surfaces. For this reason, replaceable wear plates 160 form a part of the saddle block assembly. The wear plates 160 are much less expensive and easier to replace than an entire saddle block assembly. After the wear plates 160 have reached a certain thickness, they are discarded and new ones are installed. This leaves the integrity of the saddle block assemblies intact.

The saddle block wear plates 160 need to be adjusted on a regular basis to maintain the correct gap between the components. Rather than throw the wear plates 160 away at every adjustment, they are repositioned to increase their service life. Metal shims 164 and 168 are installed between the wear plates 160 and the saddle block assembly, as shown in FIG. 3, to maintain the proper operating gap. This procedure for adjusting the gap works but is time consuming and difficult. The shims are large but very thin which makes them difficult to handle. It is also awkward to work between the handle and the saddle block assembly. The area is covered in lubricant, the access is poor and the catwalks used to reach this area cannot provide ideal access to the wear plates 160. Since the wear plate adjustment is difficult, it may not be performed or it may be performed less frequently than needed.

One of the objects of this invention is to provide a saddle block assembly with an easier method for adjustment of the wear plates by reducing the time needed to make the adjustment.

Another of the objects of this invention is to provide an adjusting saddle block assembly that performs the same function as the existing saddle block assemblies, but does not use shims and has the potential to reduce the maintenance time to adjust the gaps between components.

Another of the objects of this invention is to provide an adjusting saddle block assembly that can have a significant, positive impact on handle racking life and shipper shaft pinion life.

This invention may generally provide a saddle block assembly including a main body having a shipper shaft opening through the main body bottom end, and an eccentric pin opening in the main body top end, an eccentric pin received in an eccentric pin opening in the top end of the main body, and a wear plate support. The wear plate support has a pin receiving opening, the eccentric pin being received in the pin receiving opening. Wear plates are mounted on the bottom end of the wear plate support and are adapted to bear against the top of a dipper handle.

This invention may generally provide a saddle block assembly including a main body having a top end and a bottom end, the main body having a shipper shaft opening through the main body bottom end. The saddle block assembly also includes a tube-receiving opening through the main body between the main body top end and main body bottom end, and a tube received in the tube receiving opening. There is also means for extending the tube, means for securing the tube in the tube-receiving opening, and a wear plate mounted on the end of the tube.

Other independent features and independent advantages of the invention will become apparent to those skilled in the art upon review of the following detailed description, claims and drawings in which like numerals are used to designate like features.

Figure 1:
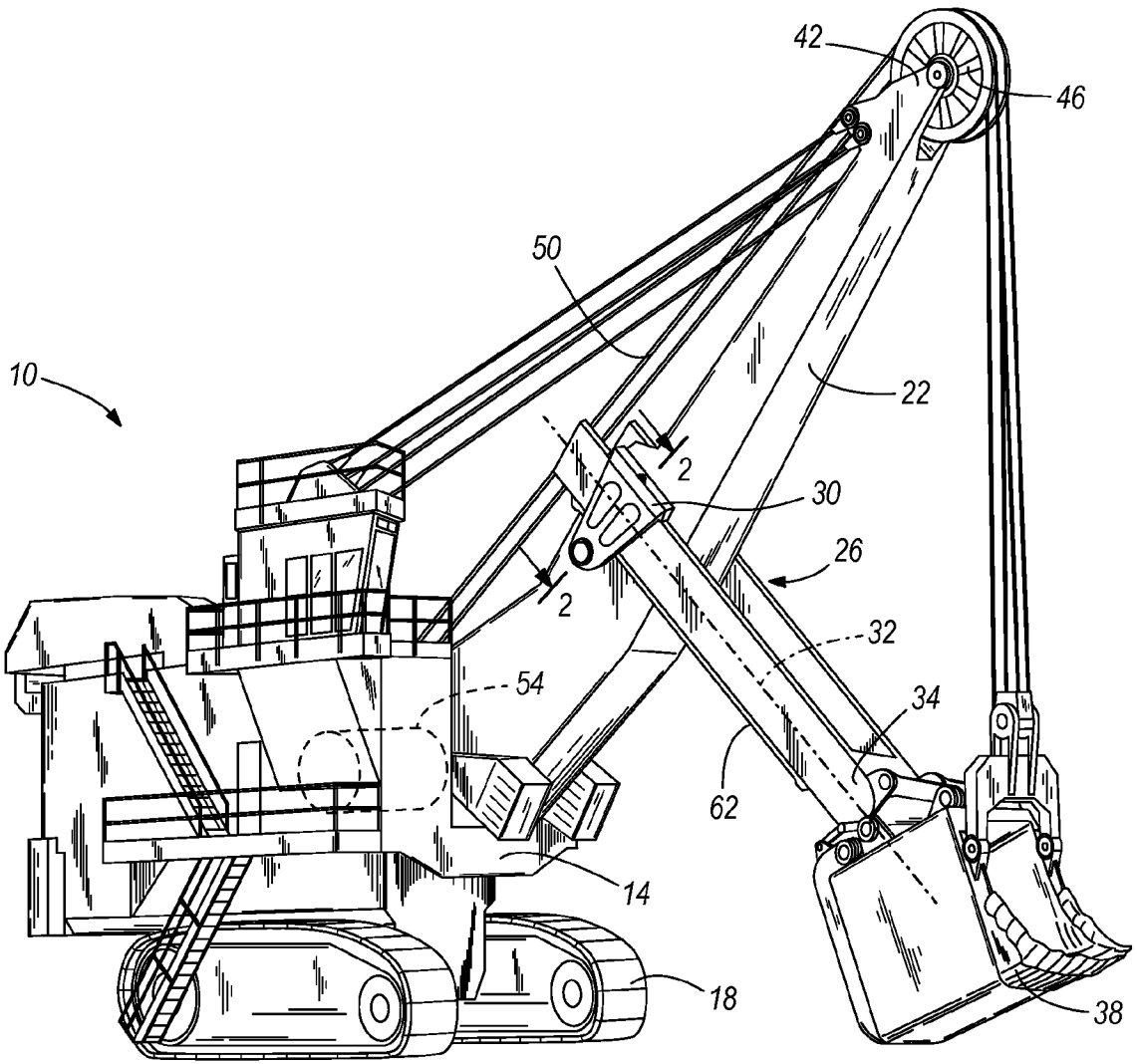
FIG. 1 is a side elevational view of a power shovel embodying aspects of the present invention.

Before the independent embodiments of the invention are explained in detail, it is to be understood that the invention is not limited in its application to the details of construction and the arrangements of the components set forth in the following description or illustrated in the drawings. The invention is capable of other independent embodiments and of being practiced or being carried out in various ways. Also, it is understood that the phraseology and terminology used herein are for the purpose of description and should not be regarded as limiting. The use of "including" and "comprising" and variations thereof herein is meant to encompass the items listed thereafter and equivalents thereof as well as additional items and equivalents thereof. The use of "consisting of" and variations thereof herein is meant to encompass only the items listed thereafter and the equivalents thereof.

DETAILED DESCRIPTION

Illustrated in FIG. 1 is a power shovel 10. It should be understood that the present invention is capable of use in other power shovels known in the art and the power shovel 10 is only provided as an example of one such power shovel. The power shovel 10 comprises a frame 14 supported for movement over the ground. Specifically, frame 14 is a revolvable housing mounted on a mobile base such as crawler tracks 18. A fixed boom 22 extends upwardly and outwardly from the frame 14. A dipper handle 26 is mounted on the boom 22 for movement about a saddle block and rack and pinion crowd drive mechanism 30 for pivotal movement relative to the boom 22 about a generally horizontal dipper handle axis 32, and for translational (non-pivotable) movement of the dipper handle 26 relative to the boom 22. The dipper handle 26 has a forward end 34. A dipper 38 is mounted on the forward end 34 of the dipper handle 26 in a conventional manner. An outer end 42 of the boom 22 has thereon a sheave 46, and a hoist cable or rope 50 extends over the sheave 46 from a winch drum 54 mounted on the frame 14 and is connected to the dipper 38.

Figure 2:
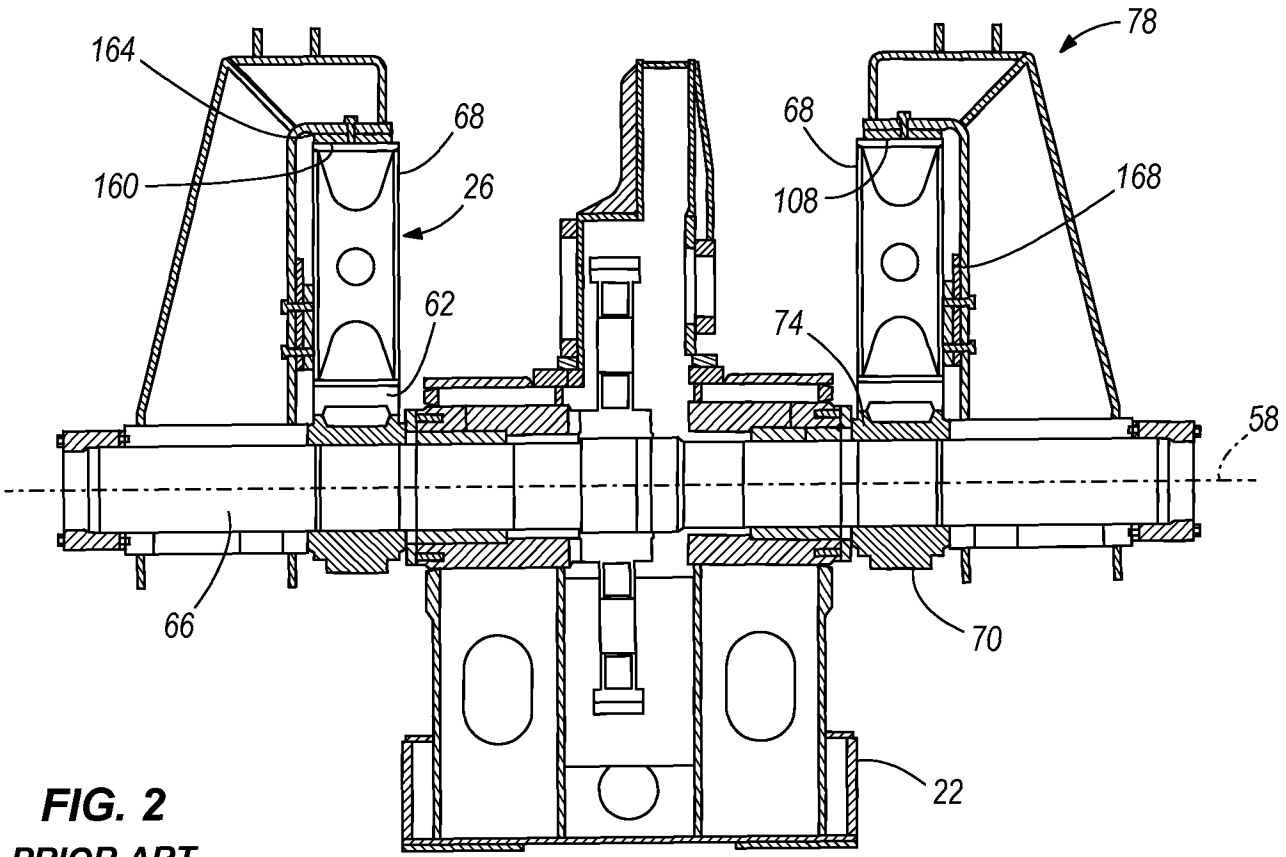
FIG. 2 PRIOR ART
FIG. 2 is a cross sectional view of the saddle block and rack and pinion crowd drive mechanism of FIG. 1, taken along the line 2-2 in FIG. 1.
Figure 3:
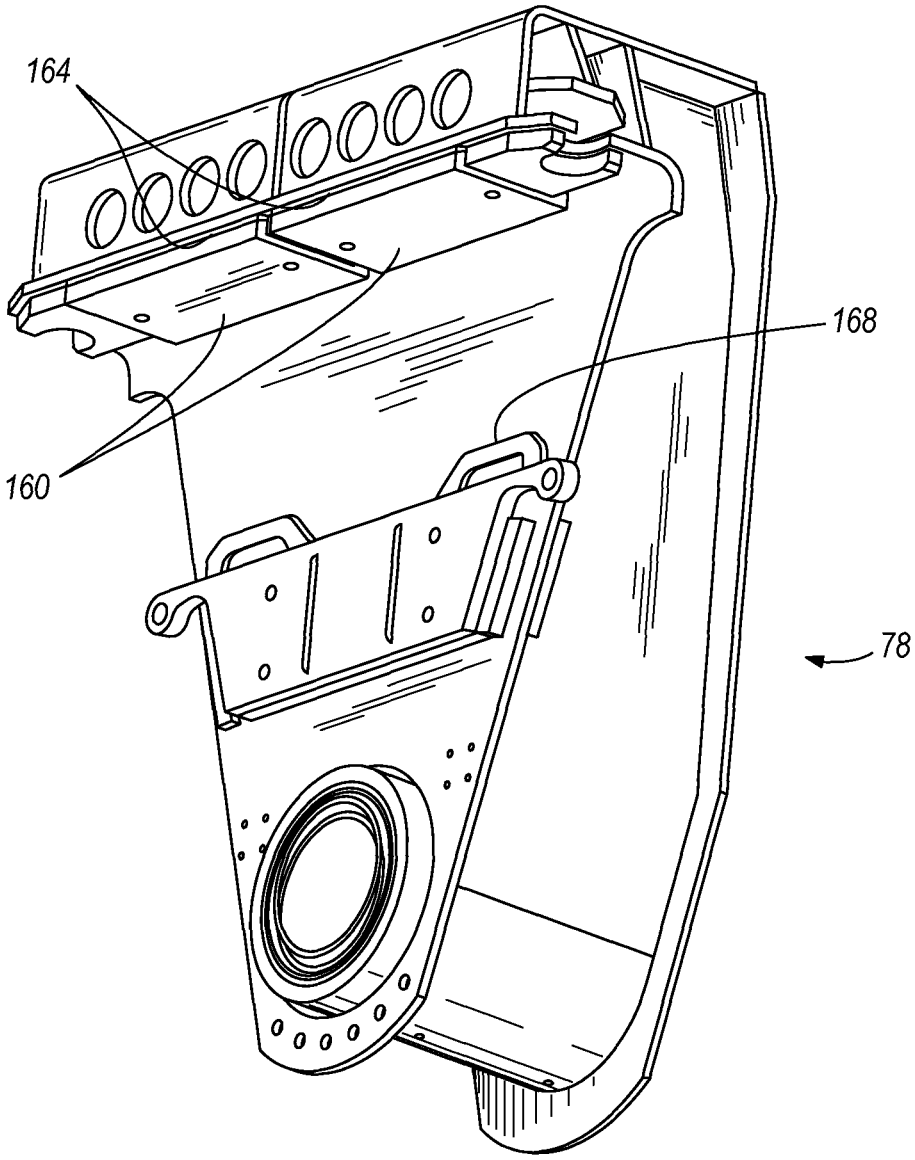
FIG. 3 PRIOR ART
FIG. 3 is a perspective view of a prior art saddle block.
Figure 4:
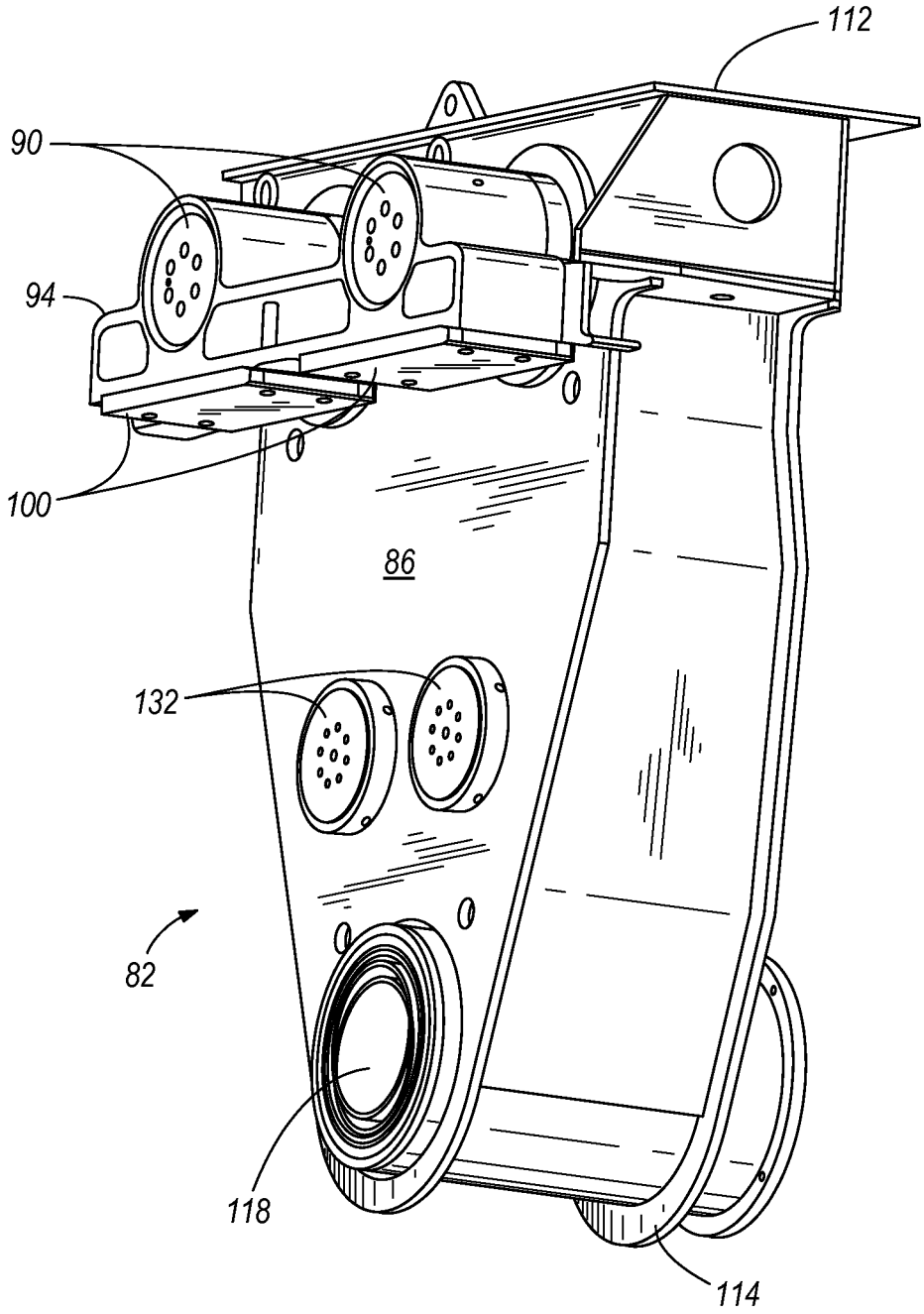
FIG. 4 is a perspective view of a saddle block according to this invention.
Figure 6:
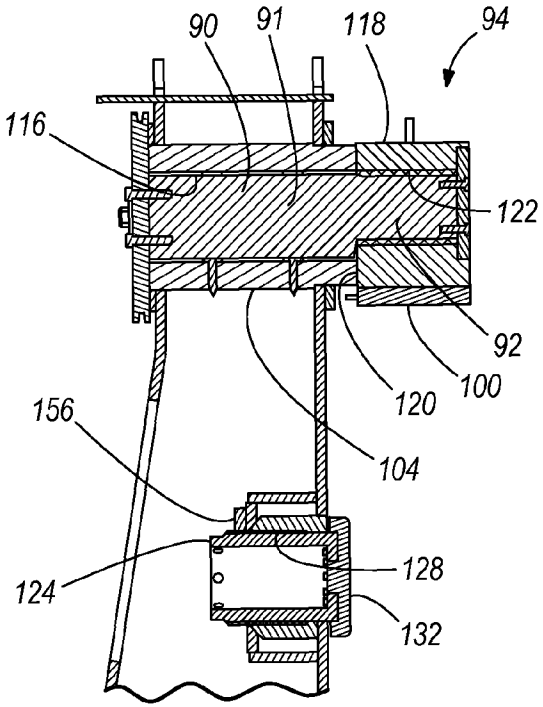
FIG. 6 is a cross sectional view of the saddle block shown in FIG. 5 taken along the line 6-6 in FIG. 5.
Figure 5:
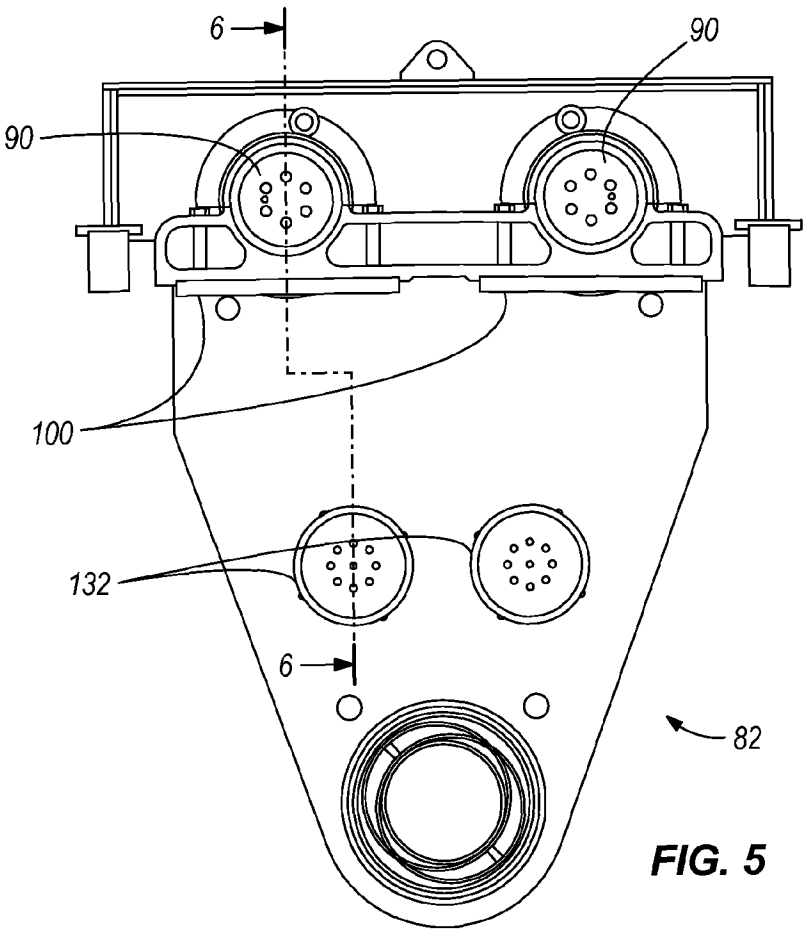
FIG. 5 is a side view of the saddle block shown in FIG. 4.

The saddle block assembly of this invention is shown in FIG. 4. The new saddle block assembly 82 is substituted for the saddle block assemblies 78 (see FIGS. 2 and 3) of the prior art. The saddle block assembly 82 includes a main body 86, two eccentric pins 90, means mounted on the main body 86 for turning the eccentric pins 90 in unison, a wear plate support or casting 94, and upper wear plates 100 mounted on the bottom end 104 (see FIG. 6) of the casting 94 and adapted to bear against the top surface 108 (see FIG. 2) of the dipper handle 26. More particularly, the main body 86 has a top end 112 and a bottom end 114, and a shipper shaft opening 118 through the main body bottom end 114. Two eccentric pin openings 116 are spaced apart at the top end 112 of the main body 86, and each of the eccentric pins 90 are received in a different one of the eccentric pin openings 116.

More particularly, the casting 94 has a top end 118 and a bottom end 120, and two pin receiving openings 122. The casting 94 receives a different one of each of the eccentric pins 90 in each of the pin receiving openings 122.

The upper wear plates 100 are attached to the casting 94 with bolts (not shown). This casting 94 is attached to the saddle block assembly 82 by the two large eccentric pins 90. An eccentric pin 90 (see FIG. 6) is a pin that has two sections 91 and 92 with different diameters that are not concentric. As the gap between the top surface 108 of the handle 26 and the upper wear plate 100 increases due to wear the eccentric pins 90 are rotated slightly. Since the pins 90 are eccentric, rotating them will cause a cam action between the pins 90 and the casting 94. This cam action changes the gap between the top surface 108 of the handle 26 and the upper wear plate 100. When the correct gap is achieved, the eccentric pins 90 are locked in place until the next adjustment.

More particularly, the means mounted on the main body 86 for turning the eccentric pins 90 in unison comprises each pin 90 having a large sprocket 136 (see FIG. 7) mounted on one end of the pin on one side 140 of the main body 86, a small double grooved sprocket 144 (shown in ghost in FIG. 7) rotatably mounted on the one side 140 of the main body 86, a first endless chain 148 trained over one of the large sprockets 136 and the small sprocket 144, and a second endless chain 148 trained over the other of the large sprockets 136 and the small sprocket 144, so that when the small sprocket 144 is rotated and the chains 148 are moved, the large sprockets 136 rotate in unison.

Figure 7:
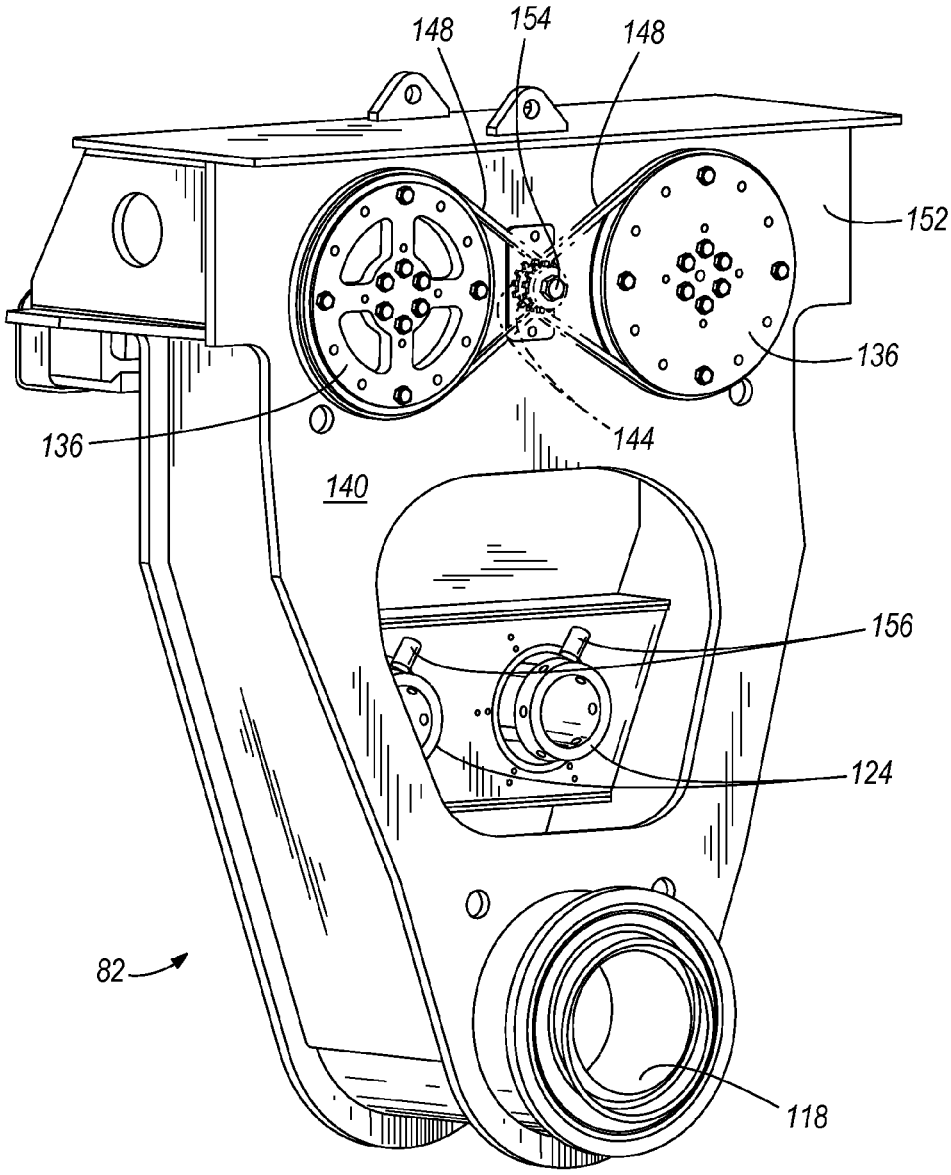
FIG. 7 is a perspective view of the back of the saddle block shown in FIG. 4.

More particularly, each of the large sprockets 136 is attached to a respective one of the outboard faces 152 of each eccentric pin 90, as shown in FIG. 7. The small sprocket 144 is keyed to an adjusting pin 154. When an adjustment is needed, the large sprockets are unlocked (locking mechanism not shown) and the adjusting pin 154 is rotated. This rotation causes the chain 148 to rotate both of the large sprockets that in turn rotate the both eccentric pins 90 together. The gap between the handle and the upper wear plate 100 changes due to the cam action of the eccentric pins 90 in the casting 94.

The saddle block assembly 82 also includes two threaded tube receiving openings 128 spaced apart in the handle horizontal movement direction. The openings 128 extend through the main body 86 between the main body top end 112 and the main body bottom end 114. The assembly 82 also includes two threaded tubes 124, each of which is received in one of the tube receiving openings 128, means for turning the tubes 124, and means for locking the tubes 124 in the tube receiving openings 128. The saddle block assembly 82 also includes two lower wear plates 132, each of which is mounted on the end of one of the tubes 124.

More particularly, when the lower wear plate loses thickness due to wear, a locking key 156 is removed and the threaded tube 124 is turned until the correct operating gap is achieved. After the gap is achieved the locking key 156 is installed again.

This saddle block assembly 82 differs from the previous saddle block assembly 78 in a number of ways. The existing saddle block assemblies 78 used wear plates that were adjusted with shims. The cam adjusting saddle block 82 uses eccentric pins 90 for the upper wear plate 100 and threaded tubes 124 for the lower wear plate 132 to adjust the gap. No shims are used to make the adjustment. The upper most wear plates on the existing saddle block assemblies 78 must be adjusted independently. The cam adjusting saddle block assembly 82 adjusts both upper wear plates 100 at the same time. This is due to the adjusting chain and sprocket assembly connected to both eccentric pins 90.

The adjusting saddle block assembly of this invention has the potential to reduce maintenance time required to adjust the wear plates. This is due to several reasons. First there are no shims to add or remove. Second both upper wear plates are attached to a casting and adjusted at the same time. Third, all adjustments are made from the outboard side of the saddle block assemblies which provides unobstructed access to all hardware.

One or more independent features of the invention may be set forth in the following claims.

What is claimed is:

1. A saddle block assembly comprising:

a main body having a shipper shaft opening and an eccentric pin opening;

an eccentric pin received in the eccentric pin opening, the eccentric pin extending along a central axis, the eccentric pin having a first portion concentric with the central axis and a second portion eccentric to the central axis;

a wear plate support having a pin receiving opening, the wear plate support receiving the eccentric pin in the pin receiving opening; and a wear plate mounted on the wear plate support and adapted to bear against the top of a dipper handle.

2. The assembly of claim 1, wherein the pin receiving opening of the wear plate support receives the second portion of the eccentric pin.

3. The assembly of claim 1, wherein the eccentric pin is pivotable about the central axis.

4. The assembly of claim 3, wherein pivoting movement of the eccentric pin causes movement of the wear plate relative to the main body.

5. The assembly of claim 3, further including a first sprocket mounted on one end of the eccentric pin on one side of the main body;

a second sprocket rotatably mounted on the one side of the main body; and an endless chain trained over the first sprocket and the second sprocket, rotation of the second sprocket causing movement of the chain, movement of the chain causing rotation of the first sprocket to thereby pivot the eccentric pin about the central axis.

6. The assembly of claim 1, wherein the pin receiving opening has a center, the center being offset from the central axis.

7. The assembly of claim 1, and further comprising a second wear plate mounted on the wear plate support and adapted to bear against the top of the dipper handle.

8. The assembly of claim 7, wherein the main body has a second eccentric pin opening, and wherein the assembly further comprises a second eccentric pin received in the second eccentric pin opening, the second eccentric pin extending along a second central axis, the second eccentric pin having a first portion concentric with the second central axis and a second portion eccentric to the second central axis, and wherein the wear plate support has a second pin receiving opening, the wear plate support receiving the second eccentric pin in the second pin receiving opening.

9. A saddle block assembly comprising:

a main body having a shipper shaft opening and a tube-receiving opening through the main body;

a tube received in the tube receiving opening, the tube having a tube end;

an extending mechanism for extending the tube relative to the main body from a retracted position, in which the tube end is a first distance from the main body, to an extended position, in which the tube end is a second distance from the main body, the second distance being greater than the first distance;

a locking mechanism for securing the tube in the tube-receiving opening; and a wear plate mounted on the tube end for movement therewith from the retracted position to the extended position.

10. The assembly of claim 9, wherein the extending mechanism includes cooperating threads on the tube-receiving opening and the tube.

11. The assembly of claim 9, wherein the locking mechanism includes a locking key removably engaged with the tube.

12. The assembly of claim 9, and further comprising a second wear plate.

13. The assembly of claim 12, wherein the main body has a second tube-receiving opening, wherein the assembly further comprises a second tube received in the second tube receiving opening, the second tube having a second tube end, and wherein the second wear plate is mounted on the second tube end.

14. The assembly of claim 13, and further comprising:

an extending mechanism for extending the second tube relative to the main body from a retracted position, in which the second tube end is a first distance from the main body, to an extended position, in which the second tube end is a second distance from the main body, the second distance being greater than the first distance; and a locking mechanism for securing the second tube in the second tube-receiving opening; and wherein the second wear plate is mounted on the second tube end for movement therewith from the retracted position to the extended position.

15. The assembly of claim 14, wherein the extending mechanism includes cooperating threads on the second tube-receiving opening and the second tube.

16. The assembly of claim 14, wherein the locking mechanism includes a locking key removably engaged with the second tube.

17. The assembly of claim 13, wherein the first-mentioned tube-receiving opening and the second tube-receiving opening are spaced apart in the main body in a generally horizontal direction.

18. A saddle block assembly comprising:

a main body having top end and a bottom end, the main body having a shipper shaft opening through the bottom end and a tube-receiving opening between the top end and the bottom end;

a first wear plate coupled to the top end and adapted to bear against a top of a dipper handle;

a tube received in the tube-receiving opening;

an extending mechanism for extending the tube relative to the main body from a retracted position, in which the tube end is a first distance from the main body, to an extended position, in which the tube end is a second distance from the main body, the second distance being greater than the first distance;

a locking mechanism for securing the tube in the tube-receiving opening; and a second wear plate mounted on the tube end for movement therewith from the retracted position to the extended position.

19. The assembly of claim 18, wherein the main body has an eccentric pin opening, wherein the assembly further comprises:

an eccentric pin received in the eccentric pin opening, the eccentric pin extending along a central axis, the eccentric pin having a first portion concentric with the central axis and a second portion eccentric to the central axis; and a wear plate support having a pin receiving opening, the wear plate support receiving the eccentric pin in the pin receiving opening; and wherein the first wear plate is mounted on the wear plate support.

20. The assembly of claim 19, and further comprising another first wear plate mounted on the wear plate support.

21. The assembly of claim 18, and further comprising another second wear plate.

22. The assembly of claim 21, wherein the main body has a second tube-receiving opening, wherein the assembly further comprises a second tube received in the second tube-receiving opening, the second tube having a second tube end, and wherein the other second wear plate is mounted on the second tube end.

23. The assembly of claim 22, and further comprising:

an extending mechanism for extending the second tube relative to the main body from a retracted position, in which the second tube end is a first distance from the main body, to an extended position, in which the second tube end is a second distance from the main body, the second distance being greater than the first distance; and a locking mechanism for securing the second tube in the second tube-receiving opening; and wherein the other second wear plate is mounted on the second tube end for movement therewith from the retracted position to the extended position.

* * * * *